US005189978A

United States Patent [19]

McAllister

[11] Patent Number: 5,189,978

[45] Date of Patent: Mar. 2, 1993

[54] OPERATING AT SEA ISLAND STATION

[75] Inventor: Keith R. McAllister, Davidsonville, Md.

[73] Assignee: The United States of America as represented by the Secretary of The Navy, Washington, D.C.

[21] Appl. No.: 788,625

[22] Filed: Nov. 1, 1991

[51] Int. Cl.[5] ..... B63B 35/44

[52] U.S. Cl. ..... 114/258; 114/264

[58] Field of Search ..... 441/3-5; 114/264, 265, 45, 258, 261, 250, 47

[56] References Cited

U.S. PATENT DOCUMENTS

| | | | |
|---|---|---|---|
| 1,341,677 | 6/1920 | Roberts | 114/261 |
| 2,287,434 | 6/1942 | Knudsen | 114/45 |
| 2,408,871 | 10/1946 | Nelson | 114/258 |
| 3,327,670 | 6/1967 | Burnett | 114/47 |
| 3,700,014 | 10/1972 | Scales et al. | 441/5 X |
| 3,957,010 | 5/1976 | Soulant, Jr. | 114/123 |
| 3,982,492 | 9/1976 | Steddum | 114/265 |
| 4,156,577 | 5/1979 | McMakin | 114/265 |
| 4,498,412 | 2/1985 | Liden | 114/264 |

OTHER PUBLICATIONS

Centerline, by David Taylor Research Center, Jun. 1989.

Floating Stable Platforms; by J. D. Hightower et al.

US Overseas Basing; The Anatomy of the Dilemma, by James Baker, 1990.

*Primary Examiner*—Sherman Basinger

*Attorney, Agent, or Firm*—Charles Miller; Gary Borda

[57] ABSTRACT

An Operating At Sea Island Station (OASIS) for deployment in an area of water a preselected distance from a body of land includes a plurality of discrete, self-sufficient operating units. Each operating unit being operable to perform a specialized function and operable in combination with other units to perform an overall task or mission. The plurality of operating units are dispersed in an area of the open sea measuring up to ten nautical (10) miles on a side. Each of the operating units includes mooring and dynamic positioning systems for maintaining the plurality of operating units in spaced apart relation within the OASIS so that any activity taking place relative to one of the operating units may progress without interference from any of the other operating units. If utilized for naval applications, the OASIS may serve as an advanced logistics support base, a critical node base or a forward operating base.

7 Claims, 5 Drawing Sheets

OPERATING AT SEA ISLAND STATION

RIGHTS OF THE GOVERNMENT

The invention described herein may be manufactured and used by or for the Government of the United States of America for governmental purposes without the payment of any royalties thereon or therefor.

BACKGROUND OF THE INVENTION

1. Field of the Invention

The present invention relates generally to an at-sea operating base for military or industrial applications and, more particularly, to an at-sea operating base formed from a plurality of discrete, functional operating units brought together to satisfy a specific basing requirement.

2. Background of the Invention

Presently, the United States military must rely on overseas operating bases located on foreign soil to maintain an effective presence throughout the world. As stated in an article by James R. Blaker entitled "U.S. Overseas Basing System Faces A Difficult Transition", *Armed Forces Journal International*, February, 1989, pages 65 through 67, continued access by the U.S. military to these overseas land bases is becoming increasingly costly from a monetary standpoint and politically more difficult to maintain.

Over the past three decades, there have been two broad categories of monetary costs associated with overseas land basing. One of these may be referred to as the "fixed" costs of basing-fixed in the sense that these costs are tied directly to the facilities and installations built and maintained at the bases. These fixed costs can vary greatly from base to base, depending on the local costs, the design of the facility and its environment. Although some fixed costs are paid for by the nation in which the base is located, the greatest portion of the fixed costs are provided for under the defense budget and are ultimately paid for by the U.S. taxpayer. It is apparent that as world-wide inflation increases, the cost to the U.S. taxpayer proportionately increases.

The other broad category of monetary costs associated with maintaining overseas land bases is referred to as "permit" costs which are paid to a foreign nation to obtain the privilege and authority to build, improve and maintain a U.S. military facility on the nations's territory. In 1990, U.S. overseas land base permit costs ran at approximately seven (7) billion dollars. The U.S. government paid approximately five (5) billion of this total, and the remainder was contributed by the host nations. To appreciate how rapidly these permit costs are rising, consider that in 1975, permit costs ran at roughly two hundred (200) million dollars, and by 1980, had risen to one (1) billion dollars. As with the increases in the fixed costs of overseas land basing, the majority of the increases in permit costs has been borne by the U.S. taxpayer.

In addition to the increased financial costs associated with the continued maintenance of overseas land bases, it has also become increasingly more difficult to deal politically with some foreign nations regarding continued U.S. access to these land bases. One need only consider Spain's rejection of a U.S. F-16 squadron in the late 1980's and the continued diplomatic sparring with the Philippines over base access and access compensation to recognize the political difficulties associated with maintaining foreign land bases.

The continued financial and political difficulties associated with the maintenance of foreign land bases has caused both the government and the industrial sector to examine alternatives to the foreign land base approach. For example, numerous concepts have been presented for airfields located at sea and for large, rectangular shaped "super islands" which in effect operate as multi-use floating complexes measuring one mile or more on a side. It has been suggested that these super islands be used as a replacement for foreign land bases. It is envisioned that the design characteristics of the super island would allow either industrial or military use.

Although the super island approach has recently been investigated to eliminate the problems associated with foreign land bases, the concept of large floating structures that can be used for floating cities, airfields or manufacturing facilities is not new. A form of the concept dates back at least to 1932 when it was seriously proposed that stable landing fields be built in the mid-Atlantic as refueling stations to extend the range of commercial aircraft. Until recently, the required technology was not available to advance the super island from the concept stage. With new developments in modular floating platform technology, however, the super island may indeed become a reality in the near future.

Although the utilization of super islands would eliminate the financial and political difficulties presently experienced with the maintenance of foreign land bases, super islands as presently envisioned would present their own set of difficulties with both construction and maintenance. For example, feasible transportation of the large modules forming the island structure from their point of manufacture to a location in international waters off the coast of a foreign land is doubtful, as is the connection of these large modules in an open seaway with today's methodology. Another anticipated limitation to the use of a structure as large as a super island containing all basing functions is its vulnerability to hostile attack.

Consequently, a need exists for a sea-based island concept which eliminates the financial and political difficulties associated with presently maintained foreign land bases and does not suffer from the construction and maintenance difficulties of the proposed super island approach.

SUMMARY OF THE INVENTION

The present invention relates to an Operating At Sea Island Station (OASIS) designed to satisfy the aforementioned needs. The Operating At Sea Island Station which is the subject of the present invention is a naval base located offshore, preferably in international waters, comprised of discrete operating units selected to meet the various missions of a forward base. The discrete operating units utilize the ocean surface and water column as land base components use real estate, and may either be moored or dynamically positioned depending upon water depth. The discrete operating units forming the OASIS may either be towed, hauled or self-propelled into position and may extend over one hundred (100) square miles or more of open sea, thus reducing its vulnerability to hostile attack. In addition, since the OASIS is formed from discrete functional or operating units, specific operating units may be selected for inclusion in the OASIS depending upon mission or task requirements.

Accordingly, the present invention is directed to an Operating At Sea Island Station (OASIS) for deployment in an area of water a preselected distance from a body of land which includes a plurality of discrete, self-sufficient operating units. Each of the operating units is positioned within the area of water and is operable to perform a specialized function. The plurality of operating units are operable in combination to perform an overall task or mission. The OASIS further includes means for maintaining the plurality of operating units in spaced apart relationship within the area of water so that any activity taking place relative to one of the operating units may progress without interference from any of the remaining operating units. Finally, the OASIS includes means for connecting a selected operating unit with other selected operating units to permit the specialized function performed by the selected operating unit to be shared with the other selected operating units.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
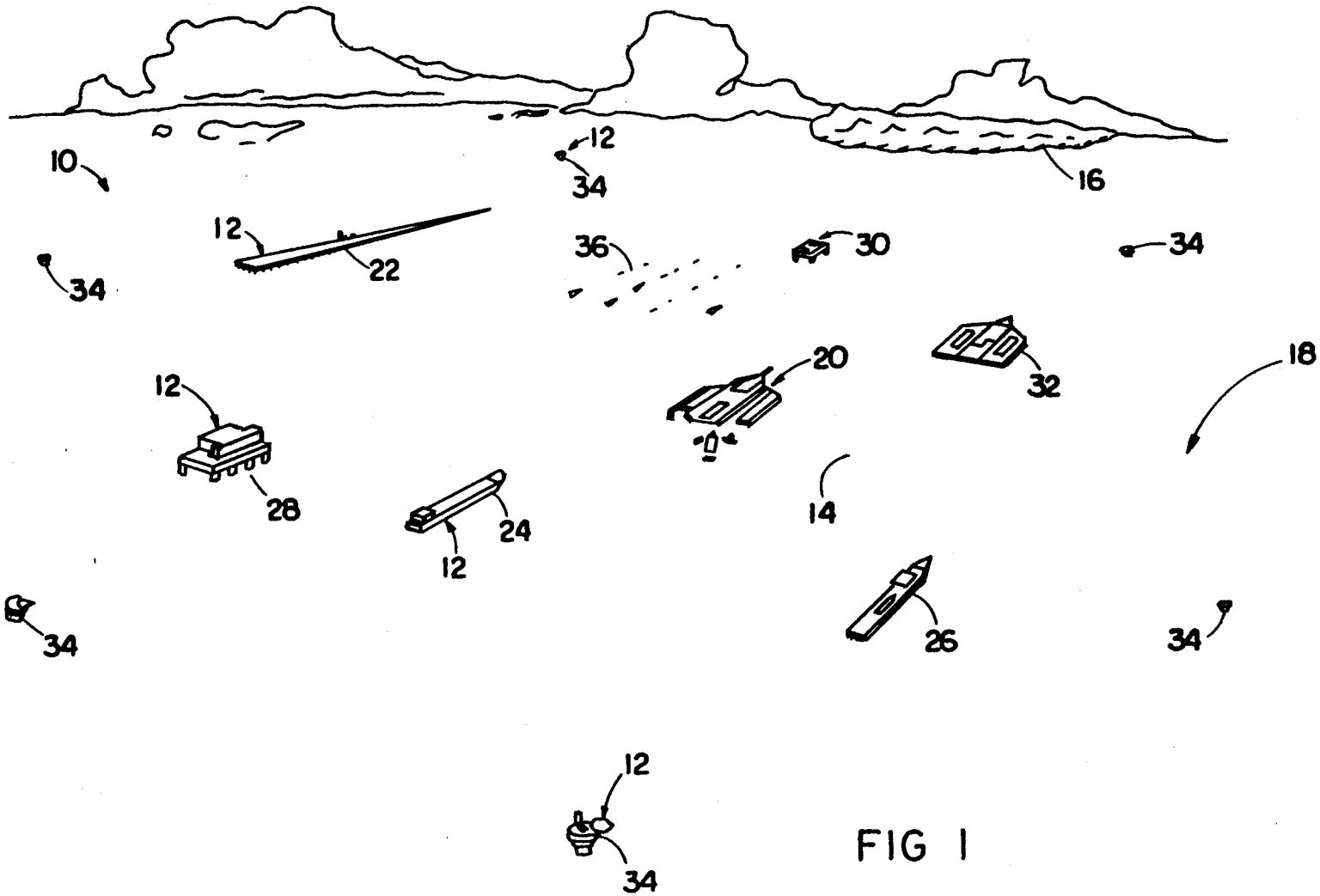
FIG. 1 is a perspective illustration of a plurality of discrete operating units following the Operating At Sea Island Station (OASIS) of the present invention.

In the following description, like reference characters designate like or corresponding parts throughout the several views. Also in the following description, it is to be understood that such terms as "forward", "rearward", "left", "right", "upwardly", "downwardly" and the like, are words of convenience and are not to be construed as limiting terms.

Referring now to the drawings, and particularly to FIG. 1, there is shown a perspective illustration of an Operating At Sea Island Station (OASIS), generally designated by the numeral 10, which is the subject of the present invention. The OASIS 10 is formed from a plurality of discrete operating units, each being generally designated by the numeral 12, brought together to meet a specific basing requirement and operable as a sea-based naval station located in international waters. Since the OASIS 10 may be positioned in international waters off the coast of most foreign nations, it will greatly reduce or eliminate the need for many of the land bases presently required to be maintained by the U.S. government in order to maintain a global presence.

The OASIS 10 uses the sea surface 14 in a manner similar to the ground on a land base. The discrete operating units 12 are relocatable and transportable since they may either be towed, transported as dry cargo on a heavy lift semi-submersible ship or self-propelled from one area of the sea to another as a mission or task performed by the OASIS 10 is completed or as the mission or task of the OASIS 10 changes. Each of the discrete operating units 12 may either be moored or dynamically positioned depending upon their location and sea depth. For example, the discrete operating units 12 may be moored in locations where the sea depth is less than one thousand (1,000) feet and positioned utilizing conventional dynamic positioning technology in locations where the sea depth ranges between one thousand (1,000) and twenty thousand (20,000) feet. Thus, the individual operating units 12 forming the OASIS 10 are configured with both mooring and dynamic positioning systems to enable their effective use over a wide range of sea depths. The fact that the OASIS 10 is transportable and relocatable from one sea location to another provides the U.S. naval forces with the capability of establishing an American presence anywhere in the world on short notice and can also serve as a sea-based station in times of crisis.

If utilized for naval applications, the OASIS 10 may serve as an advance logistics support base located near an operating area, just out of the zone of conflict. The benefits of using the OASIS 10 in this manner are a) reducing the length of the supply lines to the forces located in the operating area, and b) enabling merchant containerized cargo to be delivered for military use close to the operating area, yet away from hostile action.

The OASIS 10 may also serve as a critical node base positioned strategically as a link in a basing network, or as a forward operating base for U.S. forces operating from over-the-horizon, anti-submarine operations or drug interdiction forces.

Figure 2:
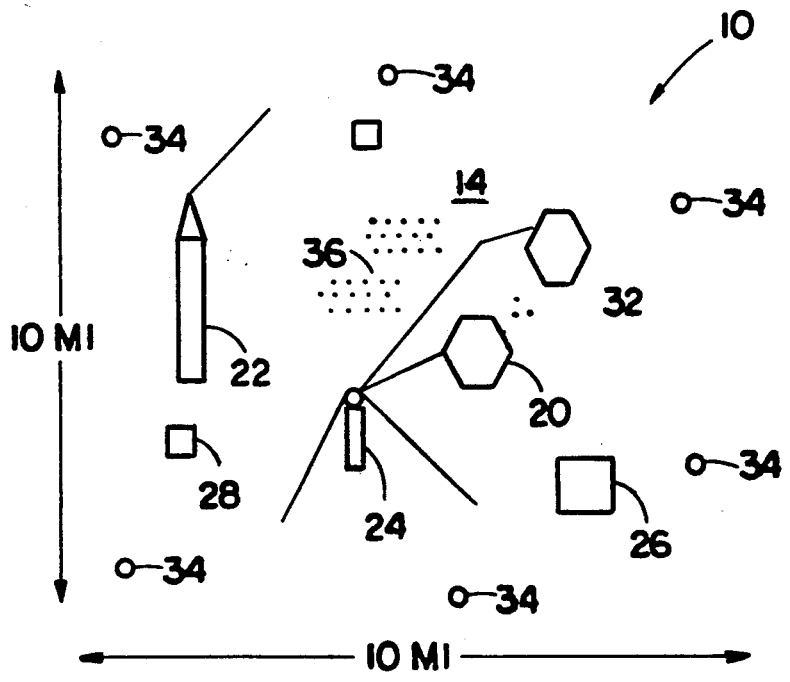
FIG. 2 is a schematic diagram illustrating the relative positions of the discrete operating units of FIG. 1.

As seen in FIGS. 1 and 2, the plurality of discrete operating units 12 forming the OASIS 10 are positioned on the sea surface 14 in international waters off the shoreline of a body of land 16. Each of the discrete operating units 12 may be positioned on the sea surface 14 within an area 18 defined by the six operations units 12 located around the periphery of the area 18.

In the example of the OASIS 10 illustrated in FIGS. 1 and 2, the plurality of discrete operating units 12 are designed to provide an air and sea-capable resupply and maintenance station. Thus, the plurality of discrete operating units 12 may include a supply center 20, an airfield 22, a fuel facility 24, a ship repair unit 26, an aircraft repair unit 28, an administrative unit 30, an ammunition center 32 and six self defense units 34 located around the periphery of the area 18. Since the operating units 12 are positioned on the sea surface 14 and spread over an area typically measuring up to ten nautical (10) miles on a side, ships entering and leaving the OASIS 10 to deliver or receive cargo, to undergo repairs or to dispatch or take on troops have sufficient room to navigate without fear of colliding with other ships moving through the OASIS 10 or with the operating units themselves. A mooring farm 36 consisting of a plurality of conventional single point mooring units is located generally in the center of the OASIS 10 to provide a docking area for ships or barges remaining in the OASIS 10 for an extended period of time. The mooring farm 36 is located in a position which is removed from the heavier traffic routes of ships passing through the OASIS 10.

Although the discrete operating units 12 identified above are operable in combination to perform the specific task of providing an air and sea-capable resupply and maintenance station, it should be apparent that the operating units 12 may be selected to form the OASIS 10 based on their individual functions and the overall task or mission to be performed by the OASIS 10.

Figure 3:
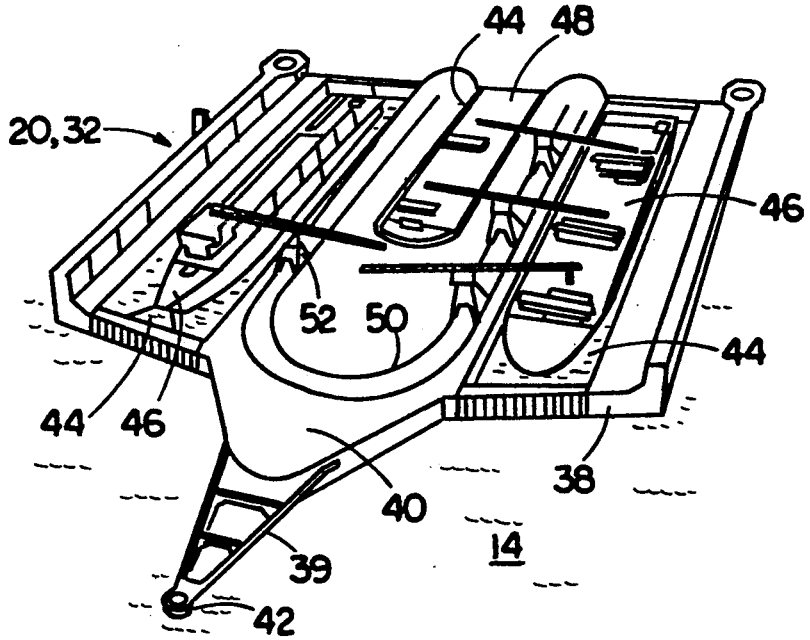
FIG. 3 is a perspective illustration of the OASIS supply center and the ammunition center.

Now referring to FIG. 3, there is shown a perspective illustration of the OASIS supply center 20 and the ammunition center 32. The supply center 20 and the ammunition center 32 will be jointly described since their constructions and methods of operation are substantially identical, the only differences between the two obviously being the types of cargo handled. Both the supply center 20 and the ammunition center 32 include a main body portion 38 which floats on the sea surface 14. A combination towing/mooring boom 39 extends outwardly from the front end 40 of the main body portion 38. When it is desired to tow the supply center 20/ammunition center 32 from one sea location to another, a towing vessel (not shown) first captures the supply center 20/ammunition center 32 at its boom 39 outer end portion 42. When it is desired to moor the supply center 20/ammunition center 32 in position within the OASIS 10, mooring rigging is also connected with the supply center 20/ammunition center 32 at its boom 39 outer end portion 42. Although not shown in FIG. 3, the supply center 20/ammunition center 32 includes a dynamic positioning system to permit its use in sea waters over one thousand (1,000) feet deep.

The supply center 20/ammunition center 32 main body portion 38 includes up to three bays 44 for receiving either on or off-loading cargo ships 46 or warehouse barges such as the warehouse barge illustrated at 48. A multiple crane cargo transport system 50, including a plurality of individual cranes 52, is operable to move stores or ammunition either between the pair of cargo ships 46 or between the cargo ships 46 and the warehouse barge 48. In one configuration, the supply center 20/ammunition center 32 is connected with the fuel facility 24 illustrated in FIGS. 1 and 2 via flexible hosing to permit the on or off-loading cargo ships 46 to take on fuel while they are docked within the supply center 20/ammunition center 32. The supply center uses a lock to capture a ship within the structure, thereby effectively coupling the ship to the structure which mitigates the relative motion between the ship and the structure. In operation, the supply center 20/ammunition center 32 may receive a maximum of two cargo ships 46, which may either be container or breakbulk, into the outer two bays 44. The stores or ammunition discharged from either of the ships 46 via the cargo transport system 50 may be palletized for transfer to underway replenishment (UNREP) ships resupplying the fleet or packaged to meet onshore unit or OASIS 10 requirements. The palletized or packaged cargo discharged from either of the cargo ships 46 may be stored on the warehouse barge 48 for future loading or immediately unloaded onto the other of the cargo ships 46. If the cargo is stored on the warehouse barge 48 for future loading, the warehouse barge 48 is typically hauled via a tugboat or workboat (not shown) to the mooring farm 36 illustrated in FIGS. 1 and 2.

Figure 4:
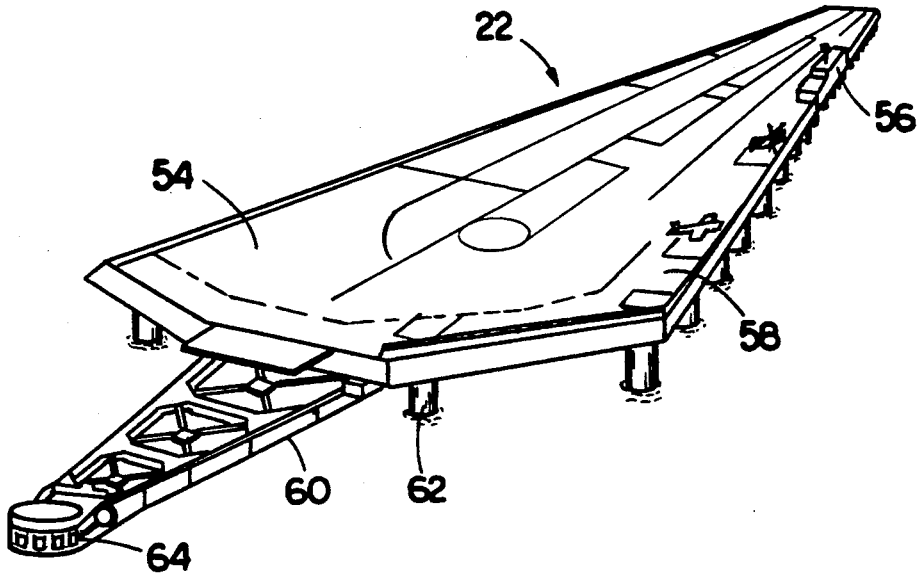
FIG. 4 is a perspective illustration of the OASIS floating airfield.

Now referring to FIG. 4, there is shown a perspective illustration of the floating airfield 22 which forms a portion of the OASIS 10. The airfield 22 is constructed of modular units each dynamically positioned with respect to one another and incorporating a span assembly between units. In deep water, the modules position themselves with respect to one another, the support structure is extended and deck panels are slid into position. The deck of one module overlaps another. In the event of severe weather, the modules disperse and reform when conditions improve. In shallow water applications, the units become submersibles and bottom in position, the support structure is extended and deck panels are slid into place. To permit bottoming of the modules, dynamic positioning thrusters are mounted above the pontoons instead of under. The airfield 22 includes a runway 54 having a length dependent upon the types of aircraft required to be received within the OASIS 10. Typically, the length of the runway 54 is sufficient to receive short take off and landing-type (STOL) aircraft and other hover-type craft.

The airfield 22 further includes an air traffic control tower 56 and an aircraft parking apron 58. The airfield 22 may also be connected with the fuel facility 24 illustrated in FIGS. 1 and 2 to permit aircraft to be refueled as required. As with the supply center 20/ammunition center 32, the airfield 22 includes a boom 60 extending from the airfield end portion 62 and having an outer end portion 64. The outer end portion 64 of the boom 60 may be secured by a towing vessel or connected with a mooring system.

Figure 5:
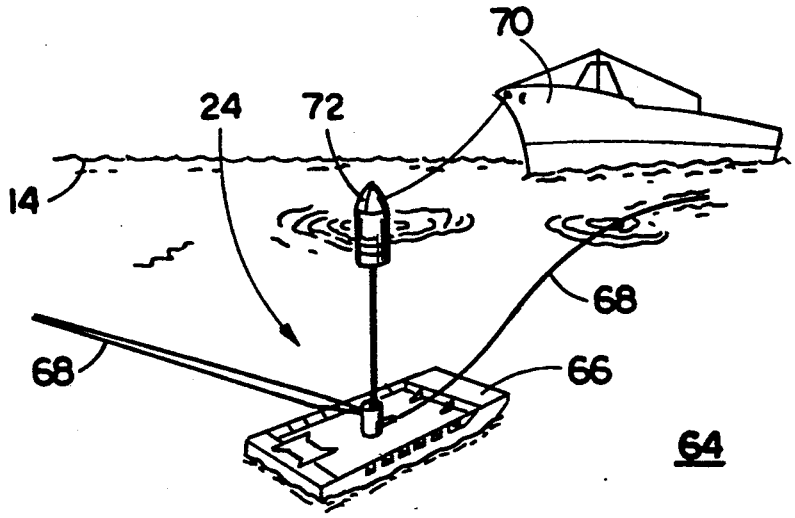
FIG. 5 is a perspective illustration of the OASIS fuel facility.

Now referring to FIG. 5, there is shown a perspective illustration of the fuel facility 24 which forms a portion of the OASIS 10. FIG. 5 is also representative of what is commonly referred to as a single anchor leg mooring (SALM). Although the fuel facility 24 is illustrated in FIG. 5 as being submerged beneath the sea surface 14 and installed on the seabed 64, it is apparent the fuel facility 24 may also take the form of a floating storage unit based on a tanker which is moored within the OASIS 10. As seen in FIG. 5, the fuel facility 24 includes a base 66 having a pair of hoses 68 extending therefrom. The hoses 68, which may either be dual product submarine hoses or flexible pipelines, provide conduits whereby fuel stored in the base or tank 66 may be transferred to vessels such as vessel 70 that require fuel before leaving the OASIS 10. As further seen in FIG. 5, a mooring buoy 72 is tethered to the base 66 to allow tankers or oilers to charge or discharge the fuel facility. With this arrangement, vessels needing fuel primarily can refuel and take stores from lighters without occupying the fuel facility 20, and commercial tankers can charge the fuel facility 20 without interrupting any refueling operations which may be taking place. As previously described, the fuel facility 24 may also be connected via flexible hosing with the supply center 20, airfield 22 and ammunition center 32 to permit fuel to be supplied to each of these operating units as required.

Figure 6:
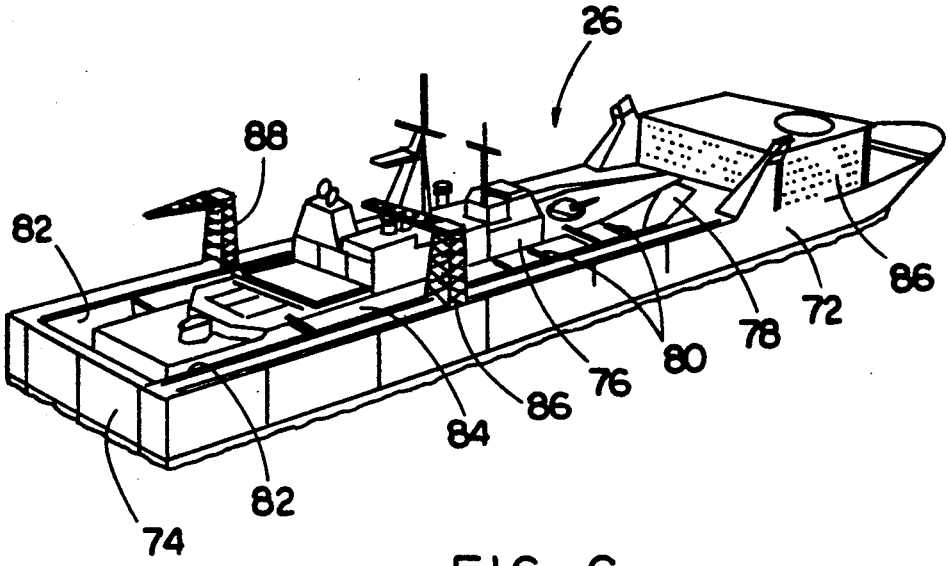
FIG. 6 is a perspective illustration of the OASIS ship repair unit.

Now referring to FIG. 6, there is shown a perspective illustration of the ship repair unit 26 which forms another portion of the OASIS 10. The ship repair unit 26 is operable to effect emergency repairs to ships taking part in overseas operations and has the capability of dry-docking a ship at sea. The ship repair unit includes a repair vessel 72 having an after lock 74 which may be opened to allow a damaged ship, such as the ship 76, to be received within the bay 78 of the repair vessel 72. After the damaged ship 76 is positioned within the bay 78, the after lock 74 is closed. The damaged ship 76 is positioned within the bay 78 such that hydraulically actuated cribbing blocks (not shown) are activated in accordance with the damaged ship class' blocking plan. Transverse supports 80, located along the bay inner walls 82, are brought into engagement with the hull 84 of the damaged ship 76 to prevent the ship 76 from shifting on its cribbing when the ship repair unit 26 moves in the seaway. The bay 78 is dewatered in order to allow repairs to commence. Because of the arrangement and location of the bay 78, the repair vessel 72 utilizes an electric drive to permit its power plant to be located in the forward structure 86. Dynamic positioning thrusters (not shown) are optimally located for self-propulsion and maneuvering. A pair of gantry cranes 88 are positioned for movement around the damaged ship 76 superstructure and are configured such that neither of the cranes have to be large enough to be able to clear the top of the damaged ship 76. The damaged ship 76 is tied into the ship repair unit 26 cooling water and electrical systems so that the damaged ship's weapons and command and control systems may still be available while the ship is being repaired.

Figure 7:
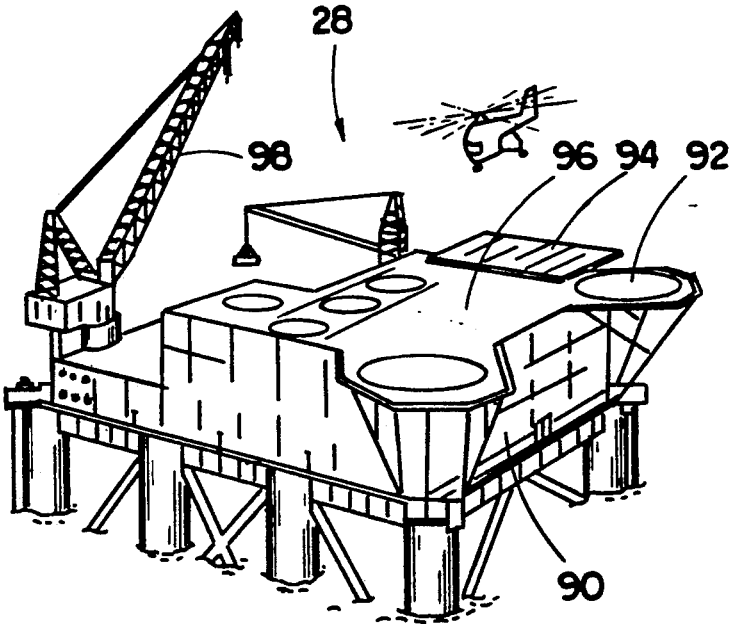
FIG. 7 is a perspective illustration of the OASIS heliport/aircraft repair unit.

Now referring to FIG. 7, there is shown a perspective illustration of the heliport/aircraft repair unit 28 forming yet another portion of the OASIS 10. The repair unit 28 is formed from a modified semi-submersible drilling rig design 90 and is configured to allow the performance of emergency repair and maintenance. Although not shown, the semi- o submersible rig 90 is equipped with both mooring and dynamic positioning systems to permit it to be located in close proximity to the airfield 22 if required. The rig 90 may either be self-propelled, towed or ship carried into position and includes a heliport 92, an aircraft parking apron 94 and may include a deployable seaplane ramp (not shown). Although the landing surface 96 of the aircraft repair unit 28 is relatively small in comparison to the runway 54 of the airfield 22, the landing surface 96 is large enough to receive both helicopters and vertical takeoff and landing aircraft (VTOL's). In addition, a crane 98 may be employed to hoist any type of aircraft up onto the landing surface 96 should repairs to the aircraft be required.

Figure 8:
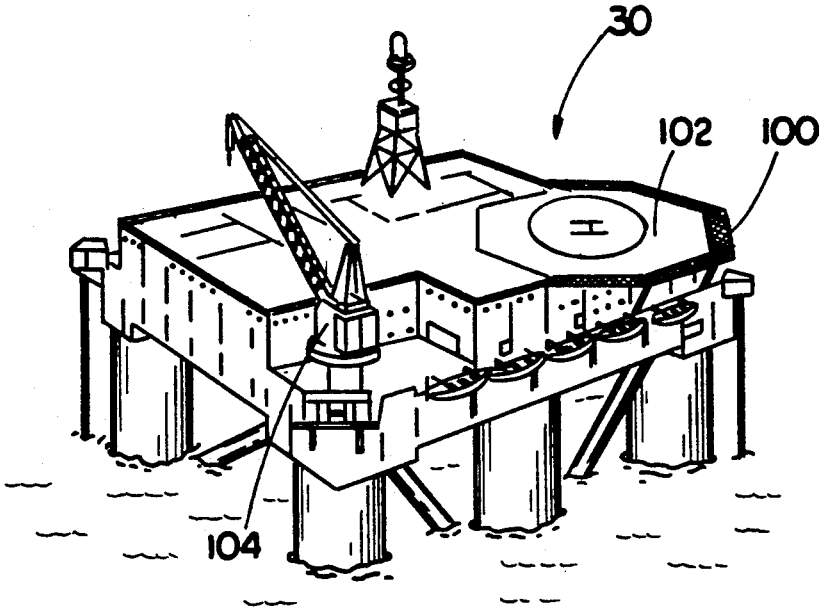
FIG. 8 is a perspective illustration of the OASIS administration unit.

Now referring to FIG. 8, there is shown a perspective illustration of the administration unit 30 forming still another portion of the OASIS 10. The administration unit 30 is formed from a modified semi-submersible drilling rig design 100 and includes both a multi-point mooring system and a dynamic positioning system. The administration unit 30 may either be self-propelled, towed or ship carried into position, and includes a helipad 102 and a crane 104 operable to oh and off-load stores. The administration unit 30 includes administrative offices, personnel quarters, a hospital, ship traffic control facilities, OASIS security offices, a communications center and an anti-submarine warfare (ASW) operations center. In addition, the administration unit 30 includes hotel-type facilities for in-transit ground forces.

Figure 9:
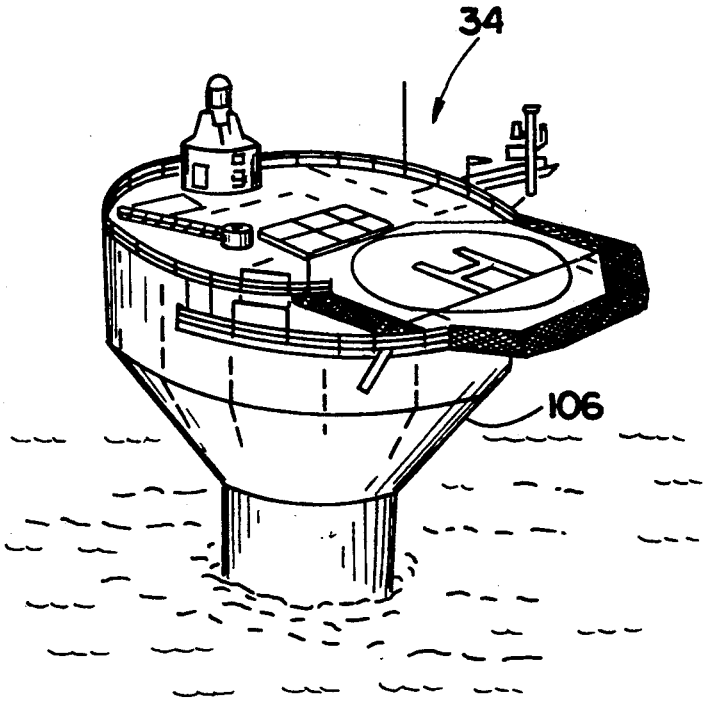
FIG. 9 is a perspective illustration of the OASIS self defense unit.

Now referring to FIG. 9, there is shown a perspective illustration of one of the self defense units 34 forming still another portion of the OASIS 10. In the embodiments of the OASIS 10 illustrated in FIGS. 1 and 2, six self defense units 34 are located around and actually define the periphery of the OASIS 10. Each self defense unit 34 is a spar buoy 106 moored with tension leg moorings, or may be a jack-up base in shallow water. Each self defense unit 34 is communication-linked with the administration unit 30 and a pair of self defense units 34 have redundant control capability. In addition, each self defense unit 34 is equipped with integrated anti-aircraft and anti-submarine defense systems. The self defense units 34 provide the OASIS 10 with additional survivability capability without dedicating fleet assets to a defensive mission and provide a first communications and warning link with passing commercial or military vessels entering the OASIS 10.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the forms hereinbefore described being merely preferred or exemplary embodiments thereof.

I claim:

1. An Operating At Sea Island Station (OASIS) for deployment in an area of water a preselected distance from a body of land, comprising:

a plurality of discrete, self-sufficient operating units positioned in spaced apart relationship within said area of water, each unit being operable to perform a specialized function and being operable in combination with other units to perform an overall task;

means for maintaining said plurality of operating units in spaced apart relationship within said area of water so that any activity taking place relative to one of said operating units may progress without interference from any of the remaining operating units;

means for connecting a selected operating unit with other selected operating units to permit the specialized function performed by said selected operating unit to be shared with said other selected operating units;

wherein said plurality of operating units include;

an administration unit formed from a semi-submersible drilling rig and configured for office and quarters spaces;

an air field made from modular components and having a length sufficient to receive designated aircraft;

a supply center for on and off-loading supplies to be used by said plurality of operating units;

a fuel storage facility for providing bulk fuel and refueling capability to shipping and aircraft utilizing said Operating At Sea Island Station;

an ammunition center for handling ammunition and hazardous cargo utilized by shipping and aircraft utilizing said Operating At Sea Island Station;

a heliport/aircraft repair unit formed from a semi-submersible platform and operable to perform emergency aircraft repair and maintenance;

a ship repair unit for performing emergency repairs to ships utilizing said Operating At Sea Island Station;

self-defense units positioned within said area of water to encircle the remainder of said plurality of operating units and operable to provide air and sea defense and;

said fuel storage facility is connected with said supply center, said airfield and said ammunition center via flexible hosing to permit fuel stored in said storage facility to be transferred to said supply center, airfield and ammunition center.

2. The Operating At Sea Island Station (OASIS) as recited in claim 1, wherein each of said operating units is relocatable and transportable from said area of water to another area of water after said overall task has been completed.

3. The Operating At Sea Island Station (OASIS) as recited in claim 2, wherein selected ones of said operating units are towable.

4. The Operating At Seal Island Station (OASIS) as recited in claim 1, wherein said plurality of operating units are operable in combination to provide an advanced logistics support base for naval operations.

5. The Operating At Sea Island Station (OASIS) as recited in claim 1, wherein said plurality of operating units are operable in combination to provide a critical node base in a basing network.

6. The Operating At Sea Island Station (OASIS) as recited in claim 1, wherein said plurality of operating units are operable in combination to provide a forward operating base for naval and other governmental forces.

7. The Operating At Sea Island Station (OASIS) as recited in claim 1, wherein said plurality of operating units are positioned in an approximately area of up to one hundred (100) square miles of water.

* * * * *